US008100268B2

(12) United States Patent
Deefholts

(10) Patent No.: US 8,100,268 B2
(45) Date of Patent: Jan. 24, 2012

(54) CHUTES FOR SORTING AND INSPECTION APPARATUS

(75) Inventor: Benedict Mark Murray Deefholts, London (GB)

(73) Assignee: Buhler Sortex Limited, London (GB)

( * ) Notice: Subject to any disclaimer, the term of this patent is extended or adjusted under 35 U.S.C. 154(b) by 0 days.

(21) Appl. No.: 11/572,895

(22) PCT Filed: Feb. 8, 2005

(86) PCT No.: PCT/GB2005/000424

§ 371 (c)(1), (2), (4) Date: Jan. 29, 2007

(87) PCT Pub. No.: WO2006/010873

PCT Pub. Date: Feb. 2, 2006

(65) Prior Publication Data

US 2007/0256959 A1 Nov. 8, 2007

(30) Foreign Application Priority Data

Jul. 27, 2004 (GB) ..... 0416717.7

(51) Int. Cl.
*B07C 1/00* (2006.01)

(52) U.S. Cl. ..... 209/655; 73/865.8; 193/2 A; 193/25 E

(58) Field of Classification Search ..... 209/655; 193/2 A, 2 D, 2 R, 4, 25 A, 25 E, 25 FT
See application file for complete search history.

(56) References Cited

U.S. PATENT DOCUMENTS

| | | | |
|---|---|---|---|
| 176,700 | A | 4/1876 | Sible |
| 606,520 | A | 6/1896 | Darrah |
| 708,081 | A | 9/1902 | Sackett |
| 708,082 | A | 9/1902 | Sackett |
| 789,381 | A | 5/1905 | Post |
| 827,349 | A | 7/1906 | Converse |
| 1,241,436 | A | 9/1917 | Peterson |
| 2,095,494 | A | 10/1937 | Dobbs |

(Continued)

FOREIGN PATENT DOCUMENTS

DE 198 47 939 A1 4/2000

(Continued)

OTHER PUBLICATIONS

British Patent Office, Search Report in priority Great Britain Application No. GB0416717.7, Dec. 24, 2004, 1 page.

(Continued)

*Primary Examiner* — Terrell Matthews

(74) *Attorney, Agent, or Firm* — Davis Wright Tremaine LLP

(57) ABSTRACT

A chute for inspection and sorting apparatus is disclosed. It comprises two sections; a first, upper section (6) and a lower, grooved section (2). The first section has a smooth, normally polished surface which allows product pieces thereon to move laterally as well as downwards. In the lower section (2) product pieces are restricted in their lateral movement by the grooves (12) and move into alignment with the grooves before being discharged into the inspection zone (22) of the apparatus. If the apparatus is for inspection only, then the product pieces continue to a collection receptacle. If the apparatus is for sorting, then an ejector (26) is included which acts in response to signals from the inspection station to eject selected pieces from the product stream. Those are deflected into a reject receptacle (28) while the remainder proceed into the collection receptacle (24).

19 Claims, 3 Drawing Sheets

U.S. PATENT DOCUMENTS

| | | | | | |
|---|---|---|---|---|---|
| 2,652,288 | A | | 9/1953 | Sands | |
| 3,216,567 | A | * | 11/1965 | Kelly et al. | 209/571 |
| 3,581,888 | A | * | 6/1971 | Kelly et al. | 209/565 |
| 3,750,945 | A | | 8/1973 | Warr | |
| 3,976,176 | A | * | 8/1976 | Kurtz et al. | 193/12 |
| 3,990,580 | A | * | 11/1976 | Self | 209/557 |
| 4,009,912 | A | * | 3/1977 | Mraz | 406/144 |
| 4,466,544 | A | | 8/1984 | Satake et al. | |
| 4,513,868 | A | * | 4/1985 | Culling et al. | 209/581 |
| 4,577,725 | A | | 3/1986 | Hunter | |
| 4,600,105 | A | | 7/1986 | Van Zyl et al. | |
| 4,628,411 | A | | 12/1986 | Balderes et al. | |
| 4,630,736 | A | * | 12/1986 | Maughan et al. | 209/587 |
| 4,699,273 | A | * | 10/1987 | Suggi-Liverani et al. | 209/580 |
| 4,715,487 | A | * | 12/1987 | Saika | 193/2 R |
| 5,016,686 | A | | 5/1991 | Gerstenkorn | |
| 5,628,411 | A | | 5/1997 | Mills et al. | |
| 5,678,477 | A | * | 10/1997 | Satake et al. | 99/519 |
| 5,791,493 | A | * | 8/1998 | Meyer | 209/245 |
| 6,059,117 | A | * | 5/2000 | Novak et al. | 209/10 |
| 6,186,304 | B1 | | 2/2001 | Håkansson et al. | |
| 6,682,294 | B2 | | 1/2004 | Carroll | |
| 2002/0008056 | A1 | * | 1/2002 | Satake et al. | 209/657 |
| 2007/0262002 | A1 | * | 11/2007 | Ito et al. | 209/580 |
| 2007/0262003 | A1 | * | 11/2007 | Kussel | 210/106 |
| 2010/0096300 | A1 | | 4/2010 | Mills et al. | |

FOREIGN PATENT DOCUMENTS

| | | | |
|---|---|---|---|
| EP | 0 065 363 | A1 | 11/1982 |
| EP | 0 146 299 | A1 | 6/1985 |
| EP | 0526711 | A1 | 2/1993 |
| EP | 0 838 273 | A2 | 4/1998 |
| GB | 951337 | | 3/1964 |
| GB | 2416533 | A | 2/2006 |
| JP | 60-26877 | | 8/1985 |
| JP | 60-242324 | A | 12/1985 |
| JP | 63-100993 | | 5/1988 |
| JP | 10128243 | A | 5/1988 |
| JP | 02-2510 | | 1/1990 |
| JP | 03-89981 | | 4/1991 |
| JP | 08252535 | A | 10/1996 |
| JP | 2001-524028 | | 11/2001 |
| JP | 2002263585 | A | 9/2002 |
| JP | 2002346483 | A | 12/2002 |
| JP | 2003-080173 | A | 3/2003 |
| JP | 2003275690 | A | 9/2003 |
| WO | WO 84/04707 | A1 | 12/1984 |
| WO | WO2004/069430 | A1 | 8/2004 |
| WO | WO 2006/010873 | A1 | 2/2006 |

OTHER PUBLICATIONS

H. K. Hazel, "Cone Feed Technique", IBM Technical Disclosure Bulletin, vol. 2, No. 1, published Jun. 1, 1959, p. 7.

EPO/ISA, "International Search Report," corresponding Patent Application No. PCT/GB2005/000424, mailed on Apr. 12, 2005, 2 pages.

EPO/ISA, "International Preliminary Report on Patentability," corresponding Patent Application No. PCT/GB2005/000424, mailed on Nov. 3, 2006, 5 pages.

UK Intellectual Property Office, "Examination Report," corresponding Patent Application No. GB0416717.7, mailed on Jul. 25, 2007, 2 pages.

UK Intellectual Property Office, "Examination Report," corresponding Patent Application No. GB0416717.7, mailed on Dec. 20, 2007, 2 pages.

China State Intellectual Property Office, "Office Action," corresponding Chinese Patent Application No. 200510084558.3, mailed on Jul. 11, 2008, 10 pages (including translation.).

EPO, "Office Action," corresponding European Patent Application No. 05 702 142.0, mailed on Aug. 19, 2008, 1 page.

USPTO, "Office Action," mailed in related U.S. Appl. No. 12/254,713 on Dec. 15, 2009, 13 pages.

USPTO, Office Action mailed in related U.S. Appl. No. 12/254,713 on Jul. 8, 2010, 9 pages.

JPO, "Notification of Reason for Refusal," corresponding Japanese Patent Application No. 2005-218036, mailed on Jul. 27, 2011, 5 pages (translation only.).

* cited by examiner

CHUTES FOR SORTING AND INSPECTION APPARATUS

CROSS-REFERENCE TO RELATED APPLICATION

This application is a national stage application of International Application No. PCT/GB2005/000424, filed Feb. 8, 2005, which claims priority to British Application No. 0416717.7, filed Jul. 27, 2004.

BACKGROUND TO THE INVENTION

This invention relates to chutes for use in inspection and sorting apparatus, particularly to such apparatus in which products are fed to a chute which delivers it to a sorting or inspection station. Sorting apparatus of this type is described in U.S. Pat. Nos. 4,513,868; 4,630,736; and 5,628,411. Inspection apparatus can use similar techniques but for the purpose of gathering data, rather than ejecting unacceptable pieces from the product stream.

For some products, grooved or channelled chutes are used to orient and position the product pieces when they leave the lower end of the chute. This facilitates the sorting or inspection process, and in sorting apparatus can help to ensure that devices and mechanisms used to eject pieces from the product stream operate only on the properly selected pieces.

In the inspection station in apparatus of the kind to which the invention relates, which will typically use an optical system to differentiate between product pieces of different quality, ideally each product piece in the product stream is separate from all adjacent pieces so that individuals can be readily identified. At the same time it is of course desirable to have as many pieces as possible in the product stream. As the product flows off the vibrator it is moving relatively slowly. In known apparatus, where the product feeds straight off a vibrator tray onto a channelled chute the product is fed straight into the channels. If two or more grains enter a channel at the same time they will travel side by side in the channel, a little slower than individual grains, that will catch up with them and then form bunches. Once in the channel there is a tendency for these bunches of product to travel at the same velocity and not separate out on the chute, thus passing the inspection station as bunches rather than streams of individual product. This reduces the efficiency of the inspection and in sorting apparatus can cause more than one grain to be ejected if a defect is detected. To avoid this it is necessary to limit the rate of flow of product into the chute and the capacity of the apparatus is reduced.

SUMMARY OF THE INVENTION

The present invention seeks to exploit the benefits of using channelled or grooved chutes in apparatus for delivering a plurality of product streams to an inspection station, but to reduce the risk of bunching and thereby maintain the efficiency of the inspection even at high bulk flow rates. According to the invention, a chute for use in this manner in sorting or inspection apparatus has an upper and a lower end, and comprises a first section with a smooth surface at the chute upper end, and a second section formed with grooves or channels, extending toward the lower end of the chute. We have found that the smooth surface of the first section allows pieces in the product stream to separate from one another such that by the time they reach the second section, they are more uniformly spaced. In this way, the risk of bunching is reduced.

In a chute according to the invention, the first and second sections are normally directly adjacent such that the product on the chute flows directly from the first section onto or into the second section. The smooth surface of the first section can have its lower edge directly over and contiguous with the walls of the channels or grooves in the second section. With this arrangement, the pieces in the product stream can move smoothly from the first to the second section, while remaining substantially in contact with one or other component at all times.

In its simplest form, the first section in a chute according to the invention comprises a plate disposed over a portion of the second section such that the channels or grooves in the second section extend toward the chute upper end beneath the first section. Conveniently, the first section can comprises a flat plate, and the second section an array of parallel channels or grooves in a plane parallel to another plate. However, either or both of the first and second sections can have a curved or undulating profile, with different combinations of profiles offering advantages in various applications of the invention. The first section typically extends at least 20% of the length of the chute from its upper to its lower end. Normally though, it will not extend more than 50% of the chute length.

Sorting apparatus using a chute according to the invention will as noted above, normally have an optical system at the sorting station. Suitable optical sorting systems are described in the patents referred to above. At the upper end of the chute a feed station normally comprises a horizontal conveyor carrying product from a hopper or other reservoir to be fed to the chute. Typically, the conveyor is a vibration conveyor, effecting some separation of the product pieces before they are fed to the chute.

As noted above, the invention is equally useful in inspection apparatus in which product in the stream leaving a chute is inspected for the purposes of data retrieval rather than sorting. Similar inspection mechanisms can be employed as are used in sorting apparatus of the kind just referred to. Such inspection is useful to gather attributes about the product flowing through the machine such as broken or distorted product pieces.

Grooved or channelled chutes are particularly suited to product with a relatively high concentration of defective product. One application of the invention is in "re-sorting" processes which involves two stages. In the first stage, only very high quality product is accepted by allowing quite a lot of good to be rejected with the poor quality product. The reject from this first pass, which has a higher concentration of defective product, is then sorted again to recover most of the good product. Channelled chutes are normally used for this second pass. Typically, less than 10% of the entire product stream is subjected to a second sort.

Chutes of the present invention are useful in apparatus for sorting and inspecting a wide range of products including for example, coffee beans and rice. Product having a generally elongate shape will of course tend to align themselves naturally in channels or grooves, but the channels and grooves are also effective for controlling the movement of product having widely different shapes.

BRIEF DESCRIPTION OF THE DRAWINGS

The invention will now be described by way of example and with reference to the accompanying schematic drawing wherein.

DESCRIPTION OF PREFERRED EMBODIMENTS

Figure 1:
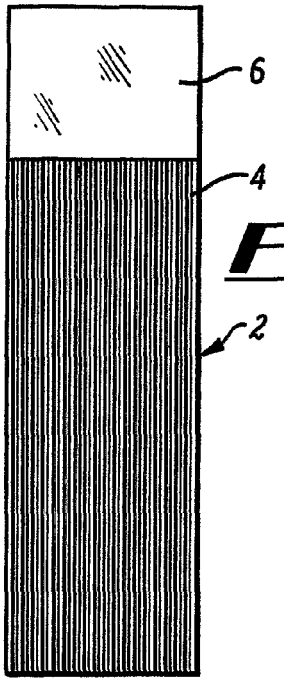
FIG. 1 is a plan view of a chute according to a first embodiment of the invention.
Figure 2:
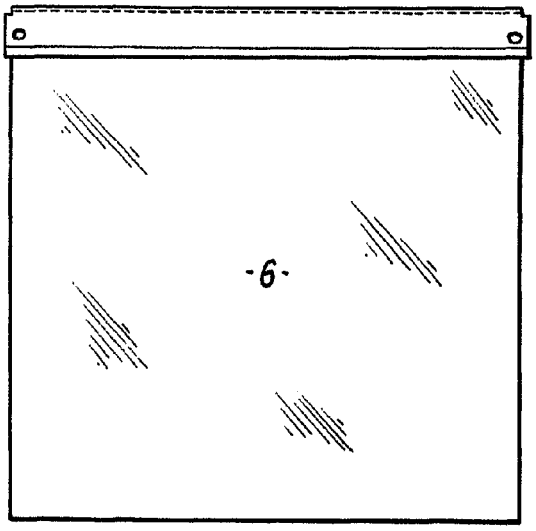
FIG. 2 is an enlarged plan view of the first section in the chute of FIG. 1.
Figure 3:
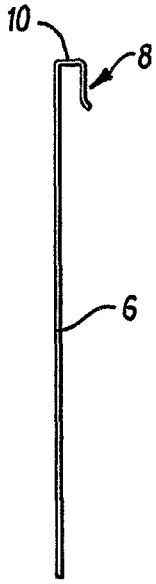
FIG. 3 is a side view of the first chute section shown in FIG. 2.

As shown in FIG. 1, a chute according to a first embodiment of the invention is of generally rectangular shape, and based on an extended body 2 of aluminium alloy or other suitable material, with the grooves 4 extending the full length thereof. As can be seen from FIGS. 2 and 3, the first section 6 of the chute comprises a separate component, removably mounted on the end of the body 4. The first section 6 is formed in stainless steel or another suitable material, and has an upper edge 10 bent to form a clip 8 for fitting over the end of the body 2. The exposed surface of the first section 6, and the grooved surface 4 of the body 2 will be highly polished to ensure the smooth passage of product pieces thereover.

Figure 4:
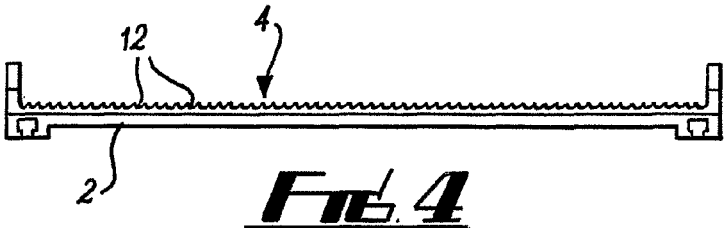
FIG. 4 shows a cross-section taken on line A-A of FIG. 1.

FIG. 4 shows the grooves in the body 2 forming the second section of the chute in FIG. 1. Each groove may be of standard U-shaped or V-shaped cross-section and, depending on the product with which the chute is to be used, may have a cross-sectional area in the range 2 $mm^2$ to 25 $mm^2$. A typical depth of each groove is no more than 3 mm.

Figure 5:
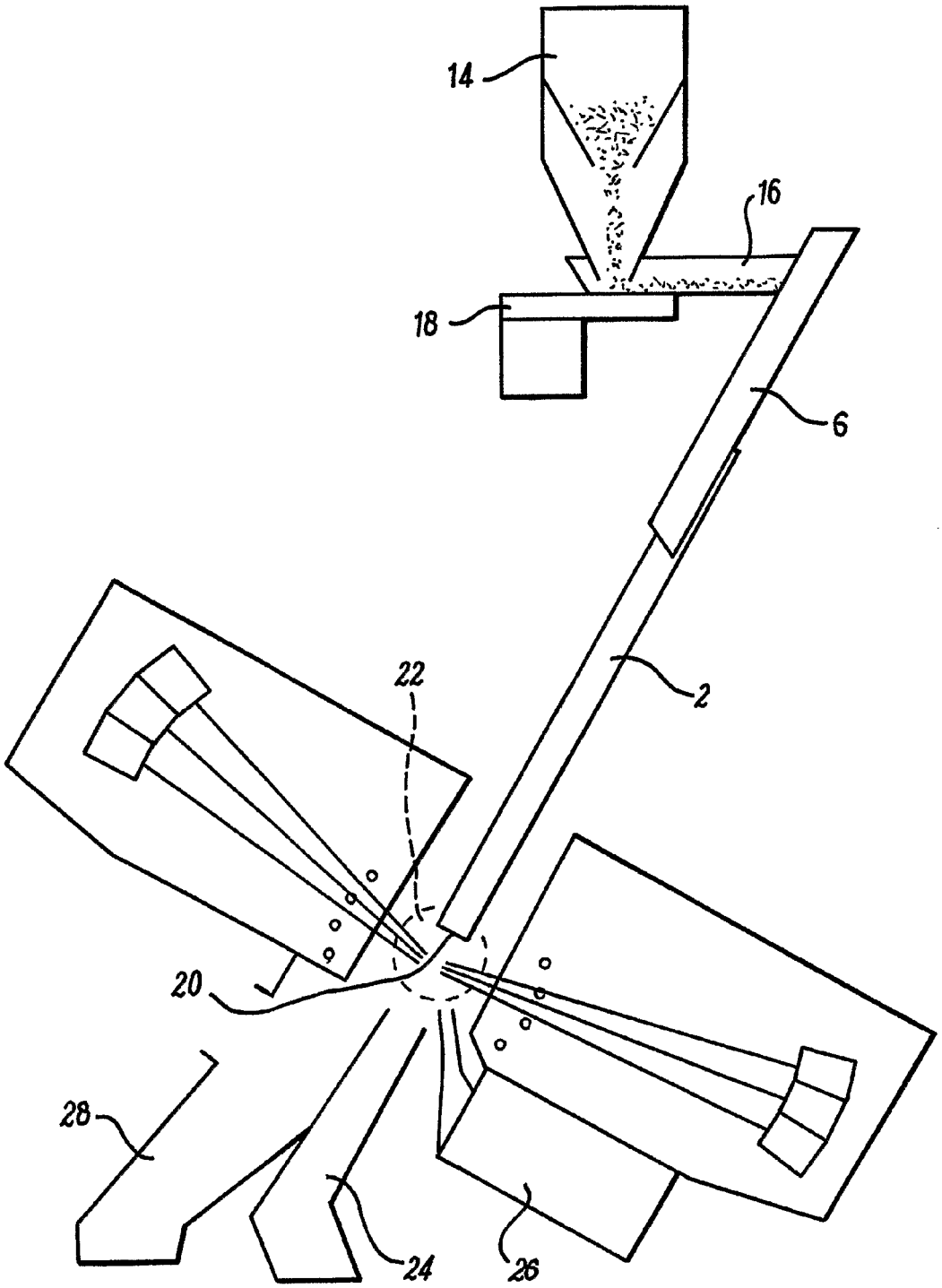
FIG. 5 illustrates sorting or inspection apparatus using a chute according to the first embodiment of the invention.

FIG. 5 illustrates how a chute of the kind illustrated in FIG. 1 can be used in sorting apparatus broadly of the kind disclosed in U.S. Pat. Nos. 4,513,868; 4,630,736; and 5,628,411, referred to above. The apparatus comprises an input hopper 14 which delivers product to be sorted or inspected to a tray 16 mounted on an infeed vibrator 18. Operation of the vibrator delivers product to the upper end of the first section 6 of the conveyor which as discussed above, has a highly polished smooth surface. Product released onto this first section 6 of the chute moves freely laterally and downwardly on the surface, and is delivered to the second section 2. On the second section the individual product pieces as they proceed downwardly, fall into and are aligned in or on the grooves 12 (FIG. 4). In this more orderly arrangement, the product pieces are released from the discharge end 20 of the chute into the inspection zone 22. In the inspection zone 22 the product pieces are illuminated and monitored using optical techniques of the kind disclosed in the patents referred to above. If the apparatus is used for inspection only, then the product pieces continue unimpeded into the receptacle 24. If the apparatus is for sorting, then an ejector normally a pneumatic ejector, is included to eject pieces from the product stream in response to signals generated by the inspection devices. Ejected product pieces are deflected from the product stream into a reject receptacle 28.

Figure 6:
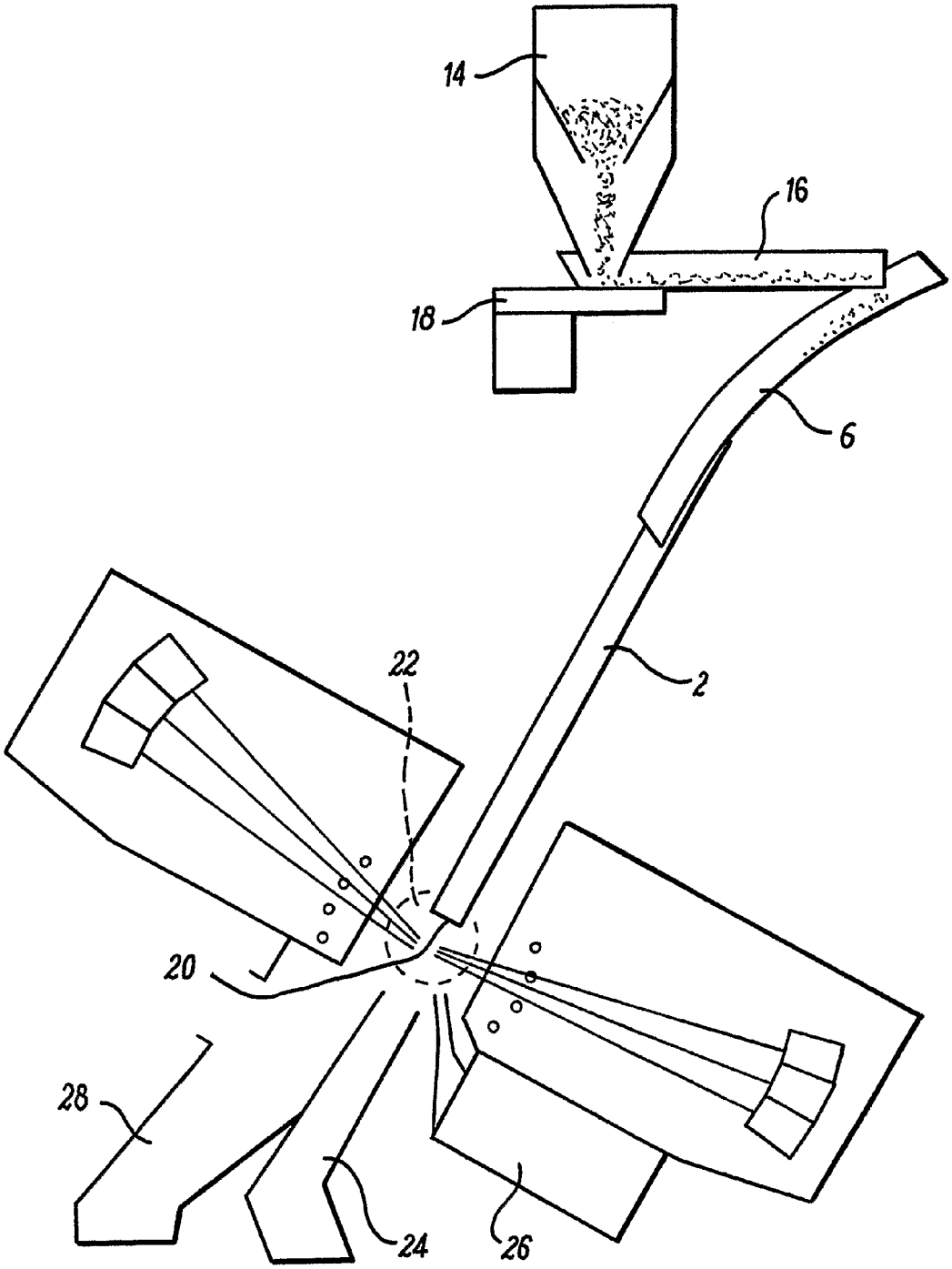
FIG. 6 illustrates sorting or inspection apparatus using a chute according to a second embodiment of the invention.

FIG. 6 illustrates apparatus essentially similar to that of FIG. 5, but in which the first section 6 of the chute has a curved profile. With this profile, product pieces delivered from the tray 16 accelerate towards the grooved second section 2 a little more slowly, and this can be of assistance where the delivery rate from the tray is relatively slow, and there is a need or desire to slow the rate of delivery of product to the second section. This can improve the lateral separation of product pieces.

A typical chute according to the invention will have a width of around 300 mm, and a length of around 1200 mm. The length of the first section will normally be at least 20%, and preferably no more than 50% of the overall chute length. In the embodiment of FIG. 1 it is around 300 mm long (25%); in FIGS. 5 and 6, around 40%. The thickness should be as small as possible to minimise the step transition from the first section to the channels or grooves, and its lower edge should of course be free of any burrs to avoid any delay in the feed.

The chutes described each consist of two sections made from different materials. However, both sections could equally be formed or machined from a single piece of material provided a smooth transition from one section to another can be assured. The second section can also be made up of separate components or even individual channels assembled or merely grouped together and mounted on the apparatus of which the chute is a part. Profiles for the first section different from those particularly described can also be used, to give different degrees of lateral and translational separation of product before it reaches the second channelled or grooved section of the chute.

We have conducted tests which demonstrate particular improvement in sorting performance, i.e., less bunching in the channelled second section of the chute, at relatively high flow rates; for example, at flow rates of the order and exceeding 1000 kg per hour in a typical 300 mm chute of the kind referred to above. It was particularly beneficial in sorting long grain rice, as the smooth first section allows the product pieces to freely separate, both laterally and in the direction of flow, before engaging the channelled second section.

The invention claimed is:

1. A chute for use in sorting or inspection apparatus to receive product from a feed station and deliver it in free flight to a sorting or inspection station, which chute has an upper end and a lower end, and comprises a first section with a smooth surface at the chute upper end, the first section having a lower edge; and a second section formed with channels on a surface extending toward the lower end of the chute, and wherein the first and second sections are in sequence with the lower edge of the first section directly over the channels of the second section and the first section is disposed over a portion of the second section such that the channels in the second section extend toward the chute upper end beneath the first section, such that substantially all of the product on the chute flows freely laterally and downwardly on the smooth surface of the first section and directly from the smooth surface of the first section onto the surface channels of the second section.

2. A chute according to claim 1 wherein the smooth surface of the first section has its said lower edge contiguous with walls of the channels in the second section.

3. A chute according to claim 1 wherein the first section comprises a plate disposed over a portion of the second section such that the channels in the second section extend toward the chute upper end beneath the first section.

4. A chute according to claim 1 wherein the first section comprises a flat plate.

5. A chute according to claim 1 wherein the first section has a curved or undulating profile.

6. A chute according to claim 4 wherein the second section comprises an array of parallel channels in a plane parallel to that of the plate.

7. A chute according to claim 1 wherein the second section has a curved or undulating profile.

8. A chute according to claim 1 wherein the first section extends at least 20% of the length of the chute from its upper end to its lower end.

9. A chute according to claim 1 wherein the first section extends no more than 50% of the length of the chute from its upper to its lower end.

10. A chute according to claim 1 wherein the channels in the second section each have a cross-sectional area in the range 2 $mm^2$ to 25 $mm^2$.

11. A chute according to claim 1 or claim 10 wherein the channels in the second section each have a depth of no more than 3 mm.

12. Sorting apparatus comprising a feed station and a sorting station and a chute for receiving product from the feed station and delivering it in free flight to the sorting station, which chute has an upper end and a lower end, and comprises a first section with a smooth surface at the chute upper end, the first section having a lower edge; and a second section formed with channels on a surface extending toward the lower end of the chute, and wherein the first and second sections are in sequence with the lower edge of the first section directly over the channels of the second section and the first section is disposed over a portion of the second section such that the channels in the second section extend toward the chute upper end beneath the first section, such that substantially all of the product on the chute flows freely laterally and downwardly on the smooth surface of the first section and directly from the smooth surface of the first section onto the surface channels of the second section.

13. Inspection apparatus comprising a feed station and an inspection station, and a chute for receiving product from the feed station and delivering it in free flight to the inspection station, which chute has an upper end and a lower end, and comprises a first section with a smooth surface at the chute upper end, the first section having a lower edge; and a second section formed with channels on a surface extending toward the lower end of the chute, and wherein the first and second sections are in sequence with the lower edge of the first section directly over the channels of the second section and the first section is disposed over a portion of the second section such that the channels in the second section extend toward the chute upper end beneath the first section, such that substantially all of the product on the chute flows freely laterally and downwardly on the smooth surface of the first section and directly from the smooth surface of the first section onto the surface channels of the second section.

14. Apparatus according to claim 12 or claim 13 wherein the feed station comprises a vibration conveyor.

15. Apparatus according to any of claims 12 to 14 wherein the sorting station comprises optical sorting instruments.

16. A chute according to claim 1, wherein the smooth surface of said first section causes the product to be more uniformly spaced when they reach the second section.

17. A chute according to claim 1, wherein the smooth surface of said first section enables the product to move freely laterally and downwardly, thereby causing the product to be more uniformly spaced when they reach the second section.

18. Apparatus according to claim 12 or claim 13, wherein the smooth surface of said first section causes the product to be more uniformly spaced when they reach the second section.

19. Apparatus according to claim 12 or claim 13, wherein the smooth surface of said first section enables the product to move freely laterally and downwardly, thereby causing the product to be more uniformly spaced when they reach the second section.

* * * * *